US009803353B2

(12) United States Patent
Kanno et al.

(10) Patent No.: US 9,803,353 B2
(45) Date of Patent: Oct. 31, 2017

(54) MEMBRANE ANCHOR MECHANISM

(71) Applicant: IHI Corporation, Tokyo (JP)

(72) Inventors: Ryuzo Kanno, Tokyo (JP); Michitaka Furikoma, Tokyo (JP); Eiji Kamiya, Tokyo (JP); Yasuhiro Shimamura, Tokyo (JP)

(73) Assignee: IHI CORPORATION, Tokyo (JP)

( * ) Notice: Subject to any disclaimer, the term of this patent is extended or adjusted under 35 U.S.C. 154(b) by 0 days.

(21) Appl. No.: 15/150,078

(22) Filed: May 9, 2016

(65) Prior Publication Data

US 2016/0251846 A1 Sep. 1, 2016

Related U.S. Application Data

(63) Continuation of application No. PCT/JP2014/079065, filed on Oct. 31, 2014.

(30) Foreign Application Priority Data

Nov. 15, 2013 (JP) ..... 2013-236943

(51) Int. Cl.
*F17C 13/00* (2006.01)
*E04B 1/62* (2006.01)
(Continued)

(52) U.S. Cl.
CPC ..... *E04B 1/40* (2013.01); *F17C 3/022* (2013.01); *F17C 13/001* (2013.01);
(Continued)

(58) Field of Classification Search
CPC .... F17C 3/02; F17C 3/04; F17C 13/10; F17C 2203/03; F17C 2305/00; F17C 2305/01;
(Continued)

(56) References Cited

U.S. PATENT DOCUMENTS 1,845,603 A * 2/1932 Huntley ..... E04F 19/0486 52/288.1
2,641,029 A * 6/1953 Trimmer ..... E04F 19/064 52/288.1
(Continued)

FOREIGN PATENT DOCUMENTS

JP 52-10722 B2 3/1977
JP 53-36758 A 4/1978
(Continued)

OTHER PUBLICATIONS

International Search Report dated Feb. 3, 2015 in PCT/JP2014/079065 (4 pages).

*Primary Examiner* — Phi A
(74) *Attorney, Agent, or Firm* — Rothwell, Figg, Ernst & Manbeck, P.C.

(57) ABSTRACT

A membrane anchor mechanism which fixes a membrane provided on an inner wall surface side of a concrete wall via a heating insulating material to the concrete wall, includes a rod-shaped leg portion which is erected on the concrete wall, an anchor which is supported by the leg portion in a state of being separated from the concrete wall and is inserted into a through-hole passing through the heat insulating material and the membrane, and a pressing part which is fixed to the anchor through the through-hole and presses the membrane.

14 Claims, 9 Drawing Sheets

(51) Int. Cl.
*E04B 1/41* (2006.01)
*F17C 3/02* (2006.01)

(52) U.S. Cl.
CPC .... *F17C 13/004* (2013.01); *F17C 2201/0157* (2013.01); *F17C 2201/052* (2013.01); *F17C 2201/054* (2013.01); *F17C 2203/03* (2013.01); *F17C 2203/0333* (2013.01); *F17C 2203/0631* (2013.01); *F17C 2205/01* (2013.01); *F17C 2209/23* (2013.01); *F17C 2223/0161* (2013.01); *F17C 2223/033* (2013.01); *F17C 2260/011* (2013.01); *F17C 2270/0136* (2013.01)

(58) Field of Classification Search
CPC ..... F17C 2305/0153; F17C 2223/0161; E04B 1/40; E04B 1/66; E04B 1/62
USPC ..... 52/287.1, 288.1
See application file for complete search history.

(56) References Cited

U.S. PATENT DOCUMENTS 3,112,043 A * 11/1963 Tucker ..... B63B 25/16 220/560.05
4,050,609 A * 9/1977 Okamoto ..... F17C 3/025 114/74 A
4,083,258 A * 4/1978 Hammett ..... B25B 5/10 29/259
4,128,069 A * 12/1978 Kotcharian ..... F17C 3/04 114/74 A
4,334,796 A * 6/1982 Latchinian ..... A47B 95/043 403/171
5,464,116 A 11/1995 Aoki et al.
5,501,359 A * 3/1996 Chauvin ..... B63B 25/16 220/560.12
6,179,515 B1 * 1/2001 Grieser ..... F16B 12/46 403/381
6,219,980 B1 * 4/2001 Peck, Jr. ..... E04F 19/028 52/255
2007/0175133 A1 * 8/2007 Woytowich ..... E04F 19/04 52/287.1
2010/0221072 A1 * 9/2010 Robertson, Jr. ..... E21D 21/008 405/259.4

FOREIGN PATENT DOCUMENTS

JP 59-77200 A 5/1984
JP 60-61596 U 4/1985
JP 62-117397 U 7/1987
JP 63-23440 B2 5/1988
JP 4-194497 A 7/1992
JP 6-331095 A 11/1994
JP 11-180494 A 7/1999
JP 2009-79736 A 4/2009

* cited by examiner

MEMBRANE ANCHOR MECHANISM

This application is a continuation application based on a PCT Patent Application No. PCT/JP2014/079065, filed on Oct. 31, 2014, whose priority is claimed on Japanese Patent Application No. 2013-236943, filed on Nov. 15, 2013. The contents of both the PCT Application and the Japanese Application are incorporated herein by reference.

TECHNICAL FIELD

The present embodiments described herein relate to a membrane anchor mechanism.

BACKGROUND

In the related art, in a membrane type cryogenic tank including a membrane in which a plurality of membrane panels are welded, in order to maintain a shape of a thin membrane having low stiffness, a configuration which is supported to be pressed to a concrete wall via a heat insulating material by a membrane anchor mechanism is used (for example, refer to Japanese Examined Patent Application, Second Publication No. S63-23440). As the membrane type cryogenic tank, tanks having various shapes are used, and for example, a tank which is formed to have a square corner portion, a cylindrical corner portion, or the like is also used widely. In Japanese Unexamined Patent Application, First Publication No. 2009-79736, a membrane anchor mechanism which supports a membrane panel (corner membrane panel) installed in a corner portion of a cryogenic tank is disclosed. The membrane anchor mechanism disclosed in Japanese Unexamined Patent Application, First Publication No. 2009-79736 is installed at a boundary portion of a haunch structural portion provided on a corner portion, and supports an edge portion of the corner membrane panel.

SUMMARY

However, the above-described haunch structure is not necessarily provided on all cryogenic tanks having the corner portion. Accordingly, the membrane anchor mechanism disclosed in Japanese Unexamined Patent Application, First Publication No. 2009-79736 cannot be adopted with respect to all cryogenic tanks. Moreover, in the membrane anchor mechanism in which the support location is limited to the edge portion of the corner membrane panel, for example, disposition in which a center of the membrane panel is pressed cannot be performed.

Moreover, when a gap is generated between the membrane panel and the concrete wall, cold insulation performance of the cryogenic tank is decreased. Particularly, in the location at which the membrane anchor mechanism is installed, since the above-described gap is easily generated, preferably, the membrane anchor mechanism is configured so that the heat insulating material is disposed even in the location at which the membrane anchor mechanism is installed.

The present disclosure is made in consideration of the above-described problems, and an object thereof is to provide a membrane anchor mechanism which can support the corner membrane panel regardless of the presence or absence of the haunch structure, can press a location which is not limited to the edge portion of the corner membrane panel, and can easily dispose the heat insulating material in the periphery.

The present disclosure adopts the following configurations as means for solving the above-described problems.

According to a first aspect of the present disclosure, there is provided a membrane anchor mechanism which fixes a metal membrane provided on an inner wall surface side of a concrete wall via a heating insulating material to the concrete wall in a cryogenic tank, including: a rod-shaped leg portion which is erected on the concrete wall; an anchor which is supported by the leg portion in a state of being separated from the concrete wall and is inserted into a through-hole passing through the heat insulating material and the membrane; and a pressing part which is fixed to the anchor exposed through the through-hole and presses the membrane.

According to the present disclosure, the anchor is attached to the rod-shaped leg portion which is erected on the concrete wall. In this way, the leg portion and the anchor are formed to be separated, and thus, it is possible to easily change an attachment posture of the anchor with respect to the leg portion. Accordingly, even when the through-hole passing through the heat insulating material and the membrane is provided at any position, the attachment posture between the leg portion and the anchor is adopted according to a formation position of the through-hole, and thus, it is possible to easily dispose the anchor at a position at which the anchor can be inserted into the through-hole. The pressing part is fixed to the anchor which is inserted into the through-hole and the membrane is pressed by the pressing part, and thus, according to the present disclosure, it is possible to press an arbitrary location of the membrane by arbitrarily setting the position of the through-hole. In addition, since the leg portion can be erected at any location of the concrete wall, it is possible to install the membrane anchor mechanism regardless of whether or not a haunch structure is provided on the concrete wall. In addition, according to the present disclosure, the anchor is supported by the rod-shaped leg portion, and thus, a large space is formed between the anchor and the concrete wall. Accordingly, it is possible to easily dispose the heat insulating material in the space, and it is possible to easily dispose the heat insulating material around the membrane anchor mechanism.

DETAILED DESCRIPTION OF THE DISCLOSURE

Hereinafter, an embodiment of a membrane anchor mechanism according to the present disclosure will be described with reference to the drawings. Moreover, in the following drawings, in order to allow each member to be a recognizable size, the scale of each member is appropriately changed.

Figure 1:
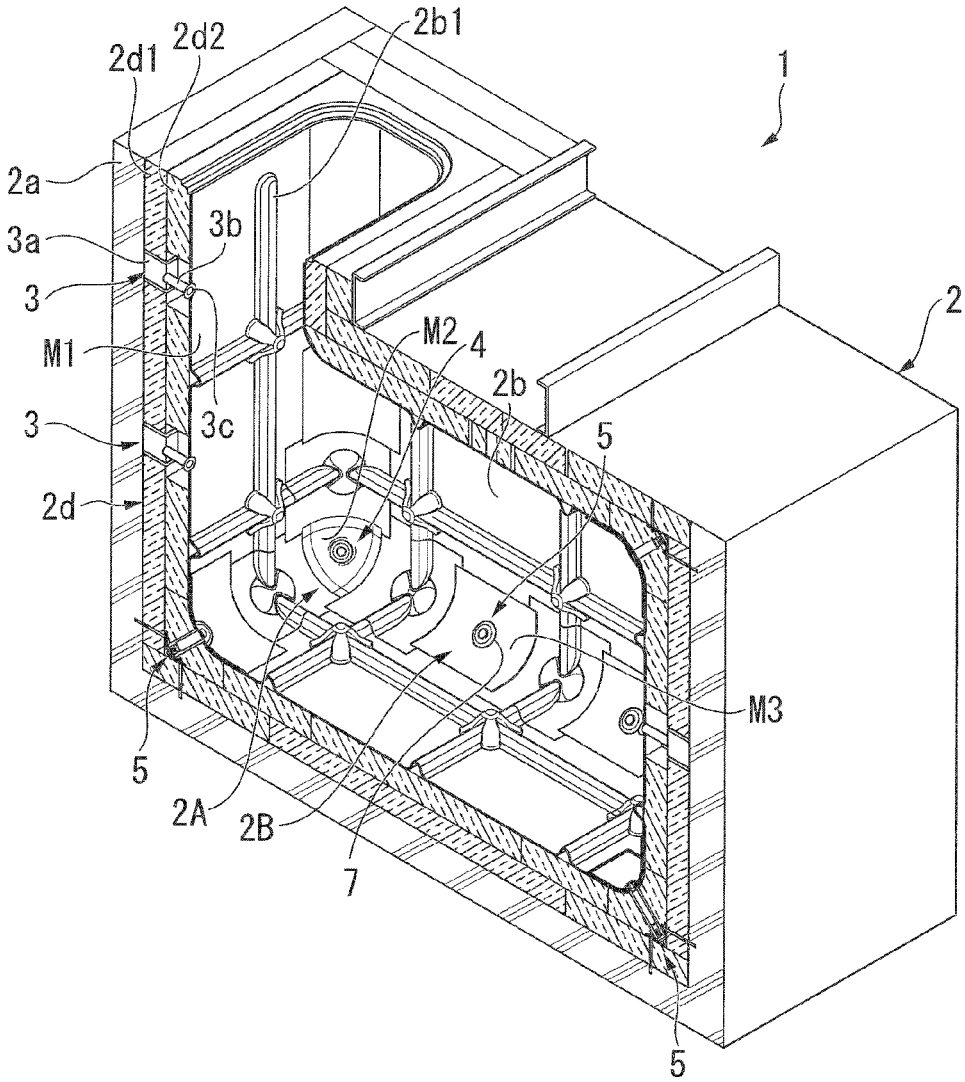
FIG. 1 is a cross-sectional perspective view showing a cryogenic tank which includes a three-surface corner membrane anchor mechanism and a two-surface corner membrane anchor mechanism according to an embodiment of the present disclosure.

FIG. 1 is a cross-sectional perspective view showing a cryogenic tank 1. The cryogenic tank 1 includes a container main body 2, a plane membrane anchor mechanism 3, and a three-surface corner membrane anchor mechanism 4 and a two-surface corner membrane anchor mechanism 5 according to an embodiment of the present disclosure.

The container main body 2 is a rectangular container which includes a concrete wall 2*a* forming an outer tank, a membrane 2*b* forming an inner tank, a vapor barrier 2*c* (refer to FIG. 2) stuck to an inner wall surface of the concrete wall 2*a*, and a cold insulating material layer 2*d* installed between the vapor barrier 2*c* and the membrane 2*b*.

The concrete wall 2*a* is a wall portion formed of concrete which forms an outer shell of the container main body 2 and a strength member which supports the membrane 2*b* or the like. The membrane 2*b* is a portion which directly comes into contact with a cryogenic liquid (for example, liquefied argon) stored in an inner portion of the tank, and is installed on the inner wall surface side of the concrete wall 2*a* via the cold insulting material layer 2*d*. A corrugation 2*b*1 which vertically and horizontally extends in a lattice shape and absorbs thermal deformation of the membrane 2*b* is provided on the membrane 2*b*. For example, the membrane 2*b* is formed by welding a sheet shaped membrane panel which is formed of stainless steel and has a thickness of several millimeters.

Since the container main body 2 is formed in a rectangular shape, the container main body 2 includes a corner portion (hereinafter, referred to as a three-surface corner portion 2A) formed at a location at which three surfaces (for example, two side wall surfaces and a bottom surface, or two side wall surfaces and a top surface) are collected, and a corner portion(hereinafter, referred to as a two-surface corner portion 2B) formed at a location at which two surfaces (for example, the side wall surface and the bottom surface, the side wall surfaces, or the side wall surface and the top surface) are collected. The membrane panel which is disposed on the corner portions is curved according to the shapes of the corner portions. Hereinafter, the membrane panel on a plane which is disposed on a region other than the corner portions is referred to as a plane membrane panel M1, the membrane panel which is disposed on the three-surface corner portion 2A is referred to as a three-surface corner membrane panel M2 (corner membrane panel), and the membrane panel which is disposed on the two-surface corner portion 2B is referred to as a two-surface corner membrane panel M3.

The vapor barrier 2*c* is a metal sheet member which is stuck to the entire region of the inner wall surface of the concrete wall 2*a*. The vapor barrier 2*c* blocks water or the like passing through the concrete wall 2*a* and improve airtightness of the container main body 2.

Figure 2:
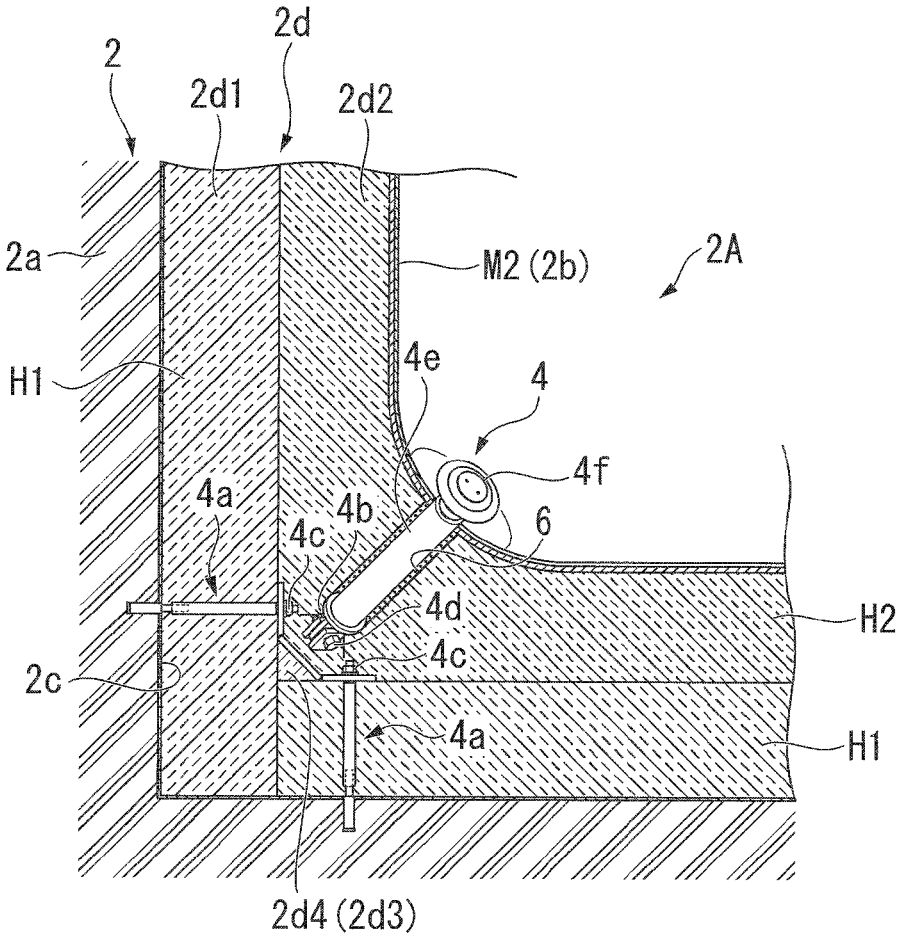
FIG. 2 is a cross-sectional view showing a three-surface corner portion including a three-surface corner membrane anchor mechanism according to the embodiment of the present disclosure.

The cold insulating material layer 2*d* includes an outer layer portion 2*d*1, an inner layer portion 2*d*2, and a filling portion 2*d*3 (refer to FIG. 2 or the like). The outer layer portion 2*d*1 is a layer which is formed on the concrete wall 2*a* side of the cold insulating material layer 2*d*, and is formed by laying cold insulating panels H1 having the same thickness without a gap. The inner layer portion 2*d*2 is a layer which is formed on the membrane 2*b* side of the cold insulating material layer 2*d*, and is formed by laying cold insulating panels H2 having the same thickness without a gap. The filling portion 2*d*3 is a portion which is filled with respect to a gap generated when the outer layer portion 2*d*1 and the inner layer portion 2*d*2 are laid, and has a shape coincident with the shape of the installed gap. For example, as the filling portion 2*d*3, a filling portion (hereinafter, referred to as a filling portion for three-surface corner portion 2*d*4) which is filled in a gap (refer to FIG. 2) formed between a base portion 4*b* and an outer layer portion 2*d*1 of the three-surface corner-membrane anchor mechanism 4 described below, or a filling portion (hereinafter, referred to as a filling portion for two-surface corner portion 2*d*5) which is filled in a gap (refer to FIG. 6) formed between a base portion 5*b* and an outer layer portion 2*d*1 of the two-surface corner membrane anchor mechanism 5 described below is installed.

For example, the cold insulating material layer 2*d* is formed of Poly Urethane Foam (PUF), and the gap between the membrane 2*b* and the concrete wall 2*a* to which the vapor barrier 2*c* is stuck is filled with the cold insulating layer.

A through-hole 6 which is disposed at a center position in the thermal deformation part of each membrane panel is provided on the membrane 2*b* and the cold insulating material layer 2*d*. An anchor 3*b* of the plane membrane anchor mechanism 3, an anchor 4*e* of the three-surface corner membrane anchor mechanism 4, or an anchor 5*e* of the two-surface corner membrane anchor mechanism 5 is inserted into the through-hole 6.

The plane membrane anchor mechanism 3 includes a base 3*a* which is provided on the inner wall surface of the concrete wall 2*a* via the vapor barrier 2*c*, the anchor 3*b* which is fixed to the base 3*a* and is inserted into the through-hole 6, and a pressing part 3*c* which is fixed to the anchor 3*b* exposed from the through-hole 6 and presses the plane membrane panel M1 from the inner portion side of the container main body 2 toward the concrete wall 2*a*.

Figure 3:
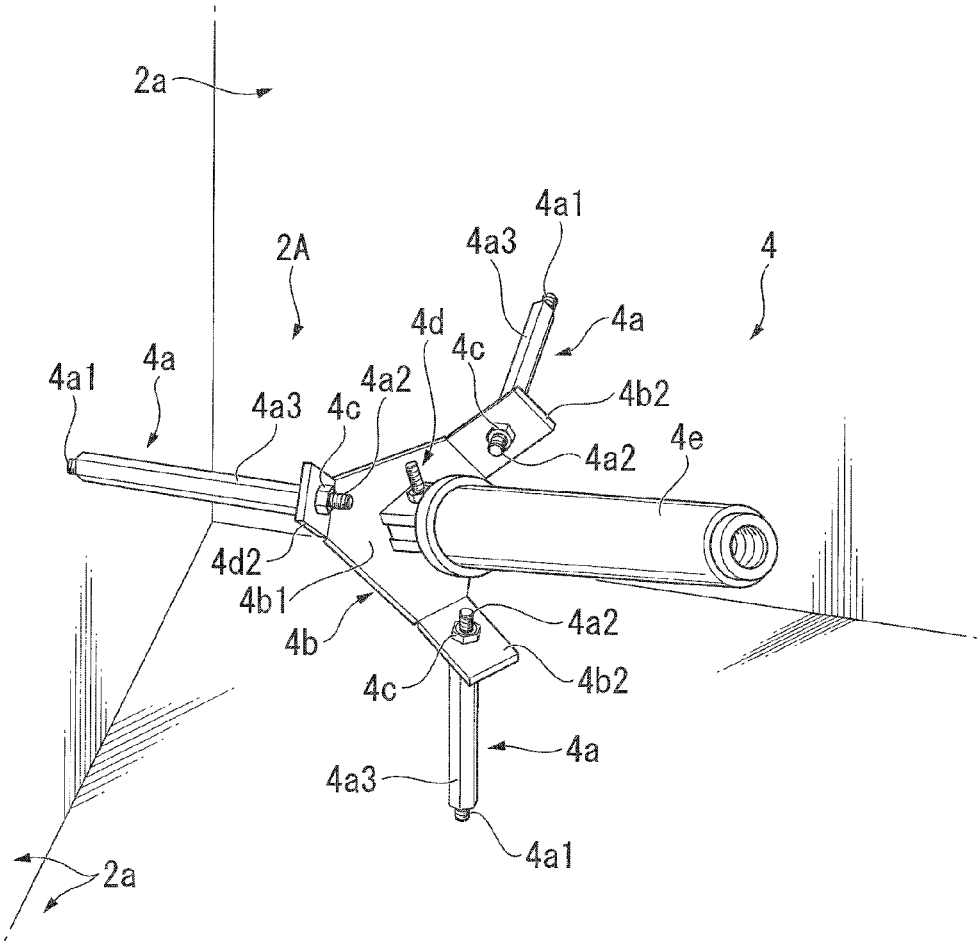
FIG. 3 is a perspective view showing the three-surface corner membrane anchor mechanism according to the embodiment of the present disclosure in which a pressing part of the three-surface corner membrane anchor mechanism is removed and a cold insulating material layer is omitted.
Figure 4A:
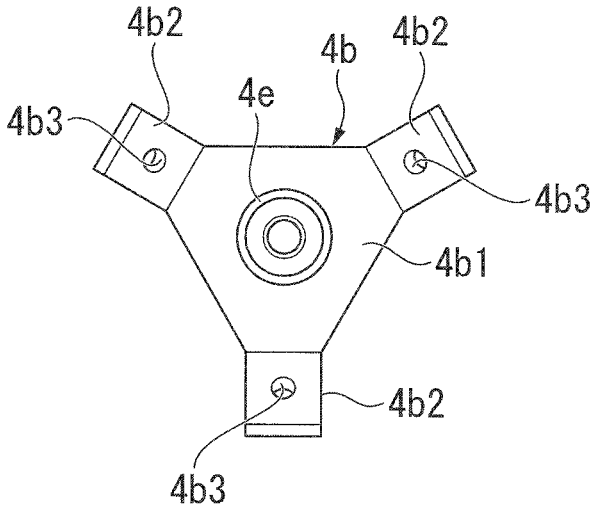
FIG. 4A is a plan view which shows the three-surface corner membrane anchor mechanism according to the embodiment of the present disclosure in which a leg portion and the pressing part are removed when viewed in a direction along an axis of an anchor.
Figure 4B:
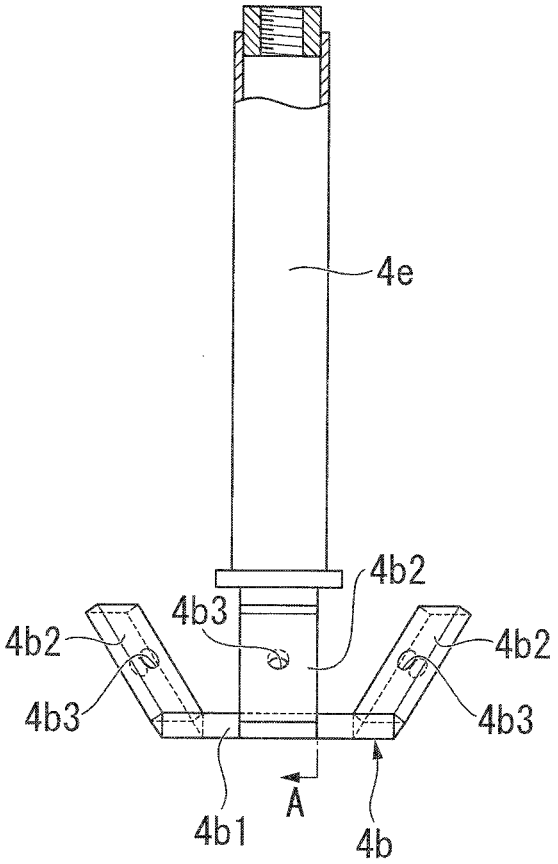
FIG. 4B is a side view when the three-surface corner membrane anchor mechanism shown in FIG. 4A is viewed in a direction orthogonal to the direction along the axis of the anchor.
Figure 4C:
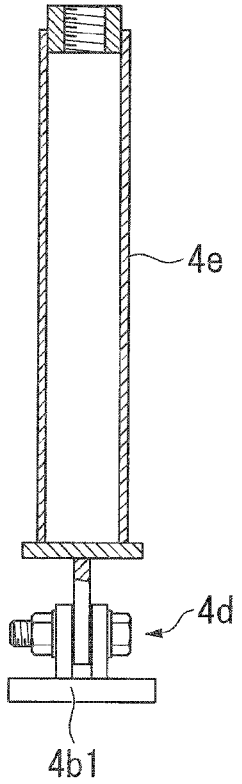
FIG. 4C is a view when the three-surface corner membrane anchor mechanism shown in FIG. 4B is viewed from arrow A.

FIG. 2 is a cross-sectional view showing the three-surface corner portion 2A including the three-surface corner membrane anchor mechanism 4. Moreover, FIG. 3 is a perspective view showing the three-surface corner membrane anchor mechanism 4 in which the pressing part 3*c* of the three-surface corner membrane anchor mechanism 4 is removed and the cold insulating material layer 2*d* is omitted. FIGS. 4A to 4C are views showing the three-surface corner membrane anchor mechanism 4 in which a leg portion 4*a* and a pressing part 4*f* are removed, of which FIG. 4A is a plan view when viewed in a direction along an axis of the anchor 4*e*, FIG. 4B is a side view when viewed in a direction orthogonal to the direction along the axis of the anchor 4*e*, and FIG. 4C is a view when is viewed from arrow A of FIG. 4B.

As shown in the drawings, the three-surface corner membrane anchor mechanism 4 is provided on the three-surface corner portion 2A, and includes a leg portion 4*a* which is provided on each of the three surfaces forming the three-surface corner portion 2A, a base portion 4*b*, a nut 4*c*, a joint 4*d*, the anchor 4*e*, and the pressing part 4*f*.

The leg portion 4*a* is a rod-shaped member which extends in the direction perpendicular to the inner wall surface of the concrete wall 2*a*, and is erected on the concrete wall 2*a* via the vapor barrier 2*c*. The leg portion 4*a* includes a first stud bolt 4*a*1 which is formed on one end portion of the concrete wall 2*a* side, a second stud bolt 4*a*2 which is formed on one end portion of the base portion 4*b* side, and a long nut 4*a*3 which forms a center portion of the leg portion. A length of the leg portion 4*a* except for the second stud bolt 4*a*2 is approximately the same as the thickness in the outer layer portion 2*d*1 of the cold insulating material layer 2*d*.

One end side of the first stud bolt 4*a*1 is embedded in the concrete wall 2*a*, screw grooves are formed on the other end side, the other end is attached to protrude to the inner portion side of the container main body 2 from the vapor barrier 2*c*, and the first stud bolt is welded to the vapor barrier 2*c*. In the first stud bolt 4*a*1, the one end side on which the screw grooves are formed is screwed to the end portions of the long nut 4*a*3. In second stud bolt 4*a*2, screw grooves are formed on both end sides, and the second stud bolt is screwed to the end portion opposite to the end portion to which the first stud bolt 4*a*1 of the long nut 4*a*3 is screwed, and is attached to protrude to the inner portion side of the container main body 2 from the base portion 4*b* through the through-hole 4*b*3 of the base portion 4*b* described below. In the long nut 4*a*3, the first stud bolt 4*a*1 is screwed to the one end side, the second stud bolt 4*a*2 is screwed to the other end side, and the long nut connects the first stud bolt 4*a*1 and the second stud bolt 4*a*2.

In this way, the leg portion 4*a* in the present embodiment includes the stud bolts (first stud bolt 4*a*1 and second stud bolt 4*a*2) provided on both ends, and the long nut 4*a*3 to which the stud bolts are screwed.

The base portion 4*b* is a portion to which three leg portions 4*a* or the anchor 4*e* is attached, and is provided at a position at which the second stud bolts 4*a*2 of three leg portions 4*a* approach one another. The base portion 4*b* includes a center plate 4*b*1 on which the anchor 4*e* is installed via the joint 4*d*, and three leg portion connection plates 4*b*2 which are provided on edge portions of the center plate 4*b*1 and to which the leg portions 4*a* are connected. Each leg portion connection plate 4*b*2 is attached to the center plate 4*b*1 at an angle formed to oppose each surface of the concrete wall 2*a* forming the three-surface corner portion 2A. The leg portion connection plate 4*b*2 is disposed at a position at which the outer layer portion 2*d*1 abuts the surface of the inner layer portion 2*d*2 side in the above-described cold insulating material layer 2*d*. Moreover, the through-hole 4*b*3 is provided on the leg portion connection plate 4*b*2. The second stud bolt 4*a*2 of the leg portion 4*a* passes through the through-hole 4*b*3 and protrudes to the side on which the anchor 4*e* is installed.

The nut 4*c* is screwed to the second stud bolt 4*a*2 which protrudes from the through-hole 4*b*3 of the leg portion connection plate 4*b*2 to the anchor 4*e* side, and the nut abuts the surface of the anchor 4*e* side of the leg portion connection plate 4*b*2 via a washer. The nuts 4*c* screwed to the second stud bolts 4*a*2 of the leg portions 4*a* press the base portion 4*b* in different directions, and thus, the base portion 4*b* is fixed.

The joint 4*d* is attached to the center plate 4*b*1 of the base portion 4*b* and rotatably supports the anchor 4*e*. The joint 4*d* is configured to include a bolt which is in a horizontal direction orthogonal to the extension direction of the anchor 4*e* as an axial direction, and a nut which is screwed to the bolt and rotatably interposes the anchor 4*e* along with the bolt. Since the anchor 4*e* is supported by the joint 4*d*, the anchor 4*e* can rotate about the horizontal direction (horizontal axis) orthogonal to the extension direction of the anchor 4*e* (FIG. 4C).

The anchor 4*e* is a cylindrical member which is long in an axial direction thereof, and screw grooves for attaching the pressing part 4*f* are formed on the inner wall surface of the tip portion of the anchor. In the anchor 4*e*, the base portion of the anchor is attached to the center plate 4*b*1 of the base portion 4*b* via the joint 4*d*, and the tip of the anchor to which the pressing part 4*f* is fixed is inserted into the through-hole 6 to be exposed toward the inside of the container main body 2. The length of the anchor 4*e* is approximately the same as the thickness of the inner layer portion 2*d*2 of the cold insulating material layer 2*d*. The anchor 4*e* is supported by the base portion 4*b*, and thus, the anchor is supported in the state being separated from the concrete wall 2*a*.

Figure 5A:
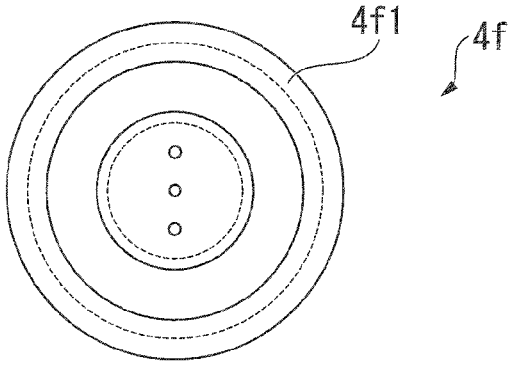
FIG. 5A is a plan view showing the pressing part of the three-surface corner membrane anchor mechanism according to the embodiment of the present disclosure.
Figure 5B:
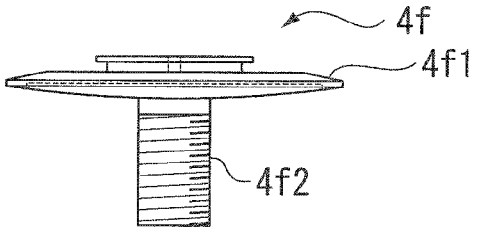
FIG. 5B is a side view showing the pressing part shown in FIG. 5A.

FIGS. 5A and 5B are views showing the pressing part 4*f*, of which FIG. 5A is a plan view of the pressing part, and FIG. 5B is a side view of the pressing part. As shown in FIGS. 4A and 4B, the pressing part 4*f* includes a disk-shaped main body 4*f* 1 and a shaft portion 4*f*2 which is integrated with the main body 4*f*1. In the main body 4*f*1, one side surface is formed in a partial shape of a spherical surface matching with the surface shape of the three-surface corner membrane panel M2, and the one side surface abuts the three-surface corner membrane panel M2 from the inner portion side of the container main body 2. The shaft portion 4*f*2 is provided on the center portion of the main body 4*f* 1, and is a columnar portion in which screw grooves are formed on the circumferential surface thereof. The shaft portion 4*f*2 is screwed to the anchor 4*e*. The shaft portion 4*f*2 is screwed to the anchor 4*e* to fasten the pressing part 4*f*, and thus, the main body 4*f*1 presses the three-surface corner membrane panel M2 toward the concrete wall 2*a*, and the three-surface corner membrane panel M2 is fixed to the concrete wall 2*a*. In addition, the edge portion of the main body 4*f*1 of the pressing part 4*f* is fixed to the three-surface corner membrane panel M2 by welding.

Figure 6:
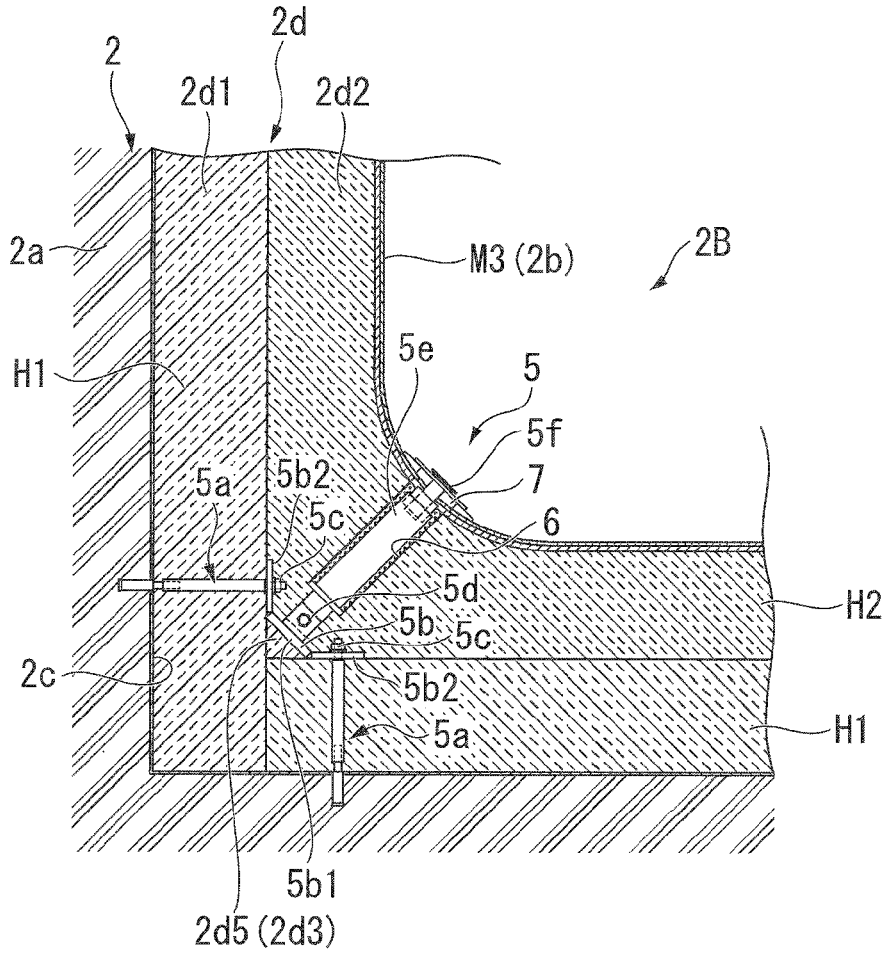
FIG. 6 is a cross-sectional view showing a two-surface corner portion including a two-surface corner membrane anchor mechanism according to the embodiment of the present disclosure.

FIG. 6 is a cross-sectional view showing the two-surface corner portion 2B including the two-surface corner membrane anchor mechanism 5. The two-surface corner membrane anchor mechanism 5 has the configuration similar to that of the three-surface corner membrane anchor mechanism 4. Accordingly, here, differences between the three-surface corner membrane anchor mechanism 4 and the two-surface corner membrane anchor mechanism 5 will be mainly described. The above-described three-surface corner membrane anchor mechanism 4 is installed in the three-surface corner portion 2A at which three surfaces are collected, and thus, the three-surface corner membrane anchor mechanism 4 includes a total of three leg portions 4*a* which are erected on the surfaces forming the three-surface corner portion 2A. On the other hand, the two-surface corner membrane anchor mechanism 5 is installed in the two-surface corner portion 2B at which two surfaces are collected, and thus, the two-surface corner membrane anchor mechanism 5 includes only two leg portions 5*a*.

The base portion 5*b* corresponds to the base portion 4*b* of the three-surface corner membrane anchor mechanism 4. However, since the two-surface corner membrane anchor mechanism 5 includes only two leg portions 5*a*, in the base portion 5*b*, only two leg portion connection plates 5*b*2 (corresponding to the leg portion connection plate 4*b*2) are provided with respect to a center plate 5*b*1 (corresponding to the center plate 4*b*1) on which a joint 5*d* is installed.

A nut 5*c* corresponds to the nut 4*c* of the three-surface corner membrane anchor mechanism 4, the joint 5*d* corresponds to the joint 4*d* of the three-surface corner membrane anchor mechanism 4, and the anchor 5*e* corresponds to the anchor 4*e* of the three-surface corner membrane anchor mechanism 4.

A pressing part 5*f* corresponds to the pressing part 4*f* of the three-surface corner membrane anchor mechanism 4. However, the pressing part 5*f* is different from the pressing part 4*f* in that the two-surface corner membrane panel M3 side of the main body is formed in a plane. Moreover, the two-surface corner membrane anchor mechanism 5 includes a spacer 7 which is installed between the pressing part 5*f* and the two-surface corner membrane panel M3.

Moreover, for example, if necessary, a foamed heat insulating material is filled in a slight gap or the like which is formed between the cold insulating material layer 2*d*, and the plane membrane anchor mechanism 3, the three-surface corner membrane anchor mechanism 4, or the two-surface corner membrane anchor mechanism 5. In addition, if necessary, a glass cloth (not shown) or the like for securing sealing is installed at the formation position of the through-hole 6 or the like.

Subsequently, portions related to the three-surface corner membrane anchor mechanism 4 in an assembly process of the cryogenic tank 1 configured above will be described.

Figure 7A:
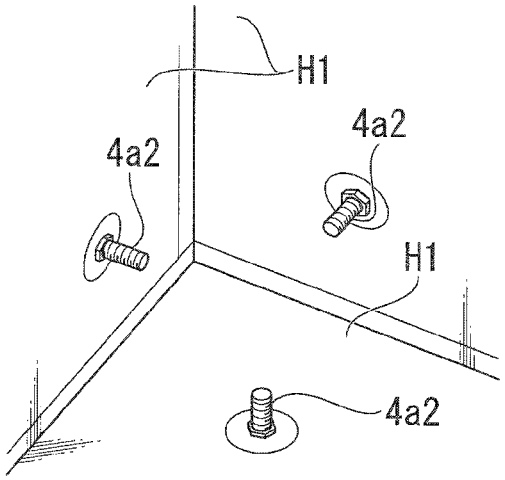
FIG. 7A is a perspective view showing an assembly process of the cryogenic tank including the three-surface corner membrane anchor mechanism according to the embodiment of the present disclosure.

First, as shown in FIG. 7A, in a state where only the leg portions 4*a* of the three-surface corner membrane anchor mechanism 4 are installed, the outer layer portion 2*d*1 (cold insulating panel H1) of the cold insulating material layer 2*d* in which the through-hole, into which each leg portion 4*a* can be inserted, is formed is disposed.

Figure 7B:
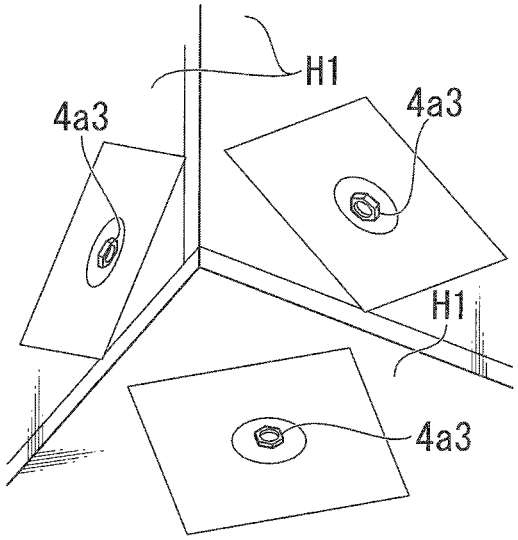
FIG. 7B is a perspective view showing the assembly process of the cryogenic tank including the three-surface corner membrane anchor mechanism according to the embodiment of the present disclosure.

Subsequently, a glass cloth (not shown) is stuck to the surface of the outer layer portion 2*d*1 of the leg portion 4*a*, and thereafter, as shown in FIG. 7B, the second stud bolts 4*a*2 of the leg portions 4*a* are removed. Moreover, as described above, since the length of the leg portion 4*a* except for the second stud bolt 4*a*2 is approximately the same as the thickness of the outer layer portion 2*d*1 of the cold insulating material layer 2*d*, the end portion of the long nut 4*a*3 is approximately flush with the surface of the outer layer portion 2*d*1 by removing the second stud bolt 4*a*2.

Figure 7C:
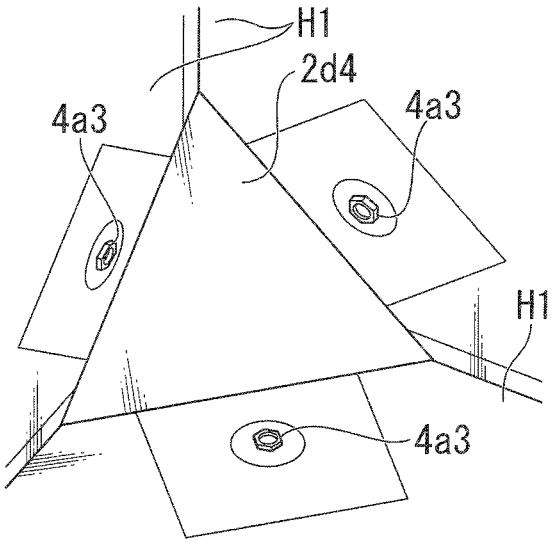
FIG. 7C is a perspective view showing the assembly process of the cryogenic tank including the three-surface corner membrane anchor mechanism according to the embodiment of the present disclosure.

Subsequently, as shown in FIG. 7C, the filling portion for three-surface corner portion 2*d*4 is installed in a corner portion which is formed of three cold insulating panels H1. The filling portion for three-surface corner portion 2*d*4 has a regular triangular pyramid shape including a bottom surface on which the base portion 4*b* of the three-surface corner membrane anchor mechanism 4 is installed.

Figure 8A:
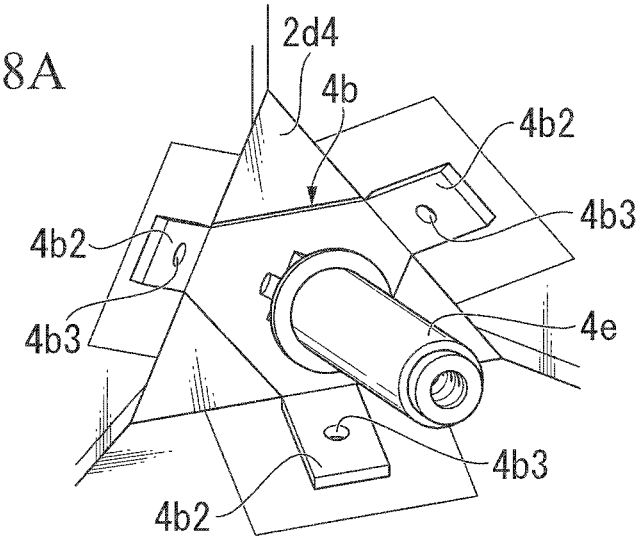
FIG. 8A is a perspective view showing the assembly process of the cryogenic tank including the three-surface corner membrane anchor mechanism according to the embodiment of the present disclosure.

Subsequently, as shown in FIG. 8A, the base portion 4*b* to which the joint 4*d* and the anchor 4*e* are attached is installed. Here, the base portion 4*b* is installed so that the position of each of the through-holes 4*b*3 of the leg portion connection plates 4*b*2 of the base portion 4*b* coincides with the end portion of each of the long nuts 4*a*3.

Figure 8B:
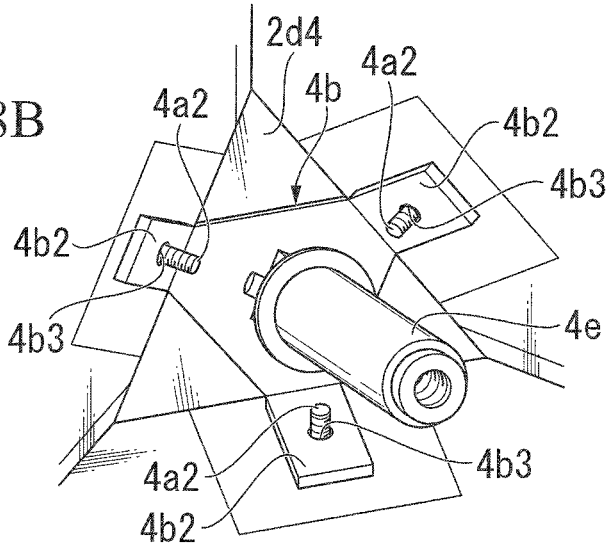
FIG. 8B is a perspective view showing the assembly process of the cryogenic tank including the three-surface corner membrane anchor mechanism according to the embodiment of the present disclosure.
Figure 8C:
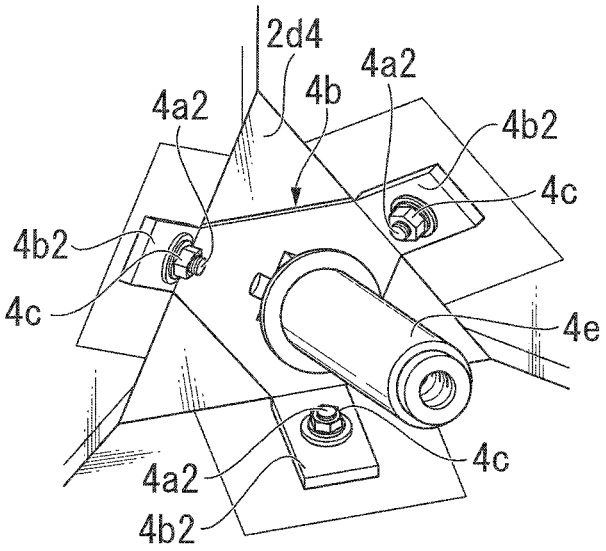
FIG. 8C is a perspective view showing the assembly process of the cryogenic tank including the three-surface corner membrane anchor mechanism according to the embodiment of the present disclosure.

Subsequently, as shown in FIG. 8B, each of the removed second stud bolts 4*a*2 is screwed to each of the long nuts 4*a*3 again from the outside of the leg portion connection plate 4*b*2. Moreover, as shown in FIG. 8C, the nut 4*c* is screwed to each of the second stud bolts 4*a*2 via a washer, the nut 4*c* is fastened so that the base portion 4*b* is pressed to the filling portion for three-surface corner portion 2*d*4, and each of the anchors 4*e* is fixed.

Thereafter, the glass cloth (not shown) is stuck to cover each of the leg portion connection plate 4*b*2, and the inner layer portion 2*d*2 of the cold insulating material layer 2*d* in which the through-hole 6, into which the anchor 4*e* is inserted, is formed is installed. In addition, the three-surface corner membrane panel M2 is disposed on the surface of the inner layer portion 2*d*2, the pressing part 4*f* is fixed to the anchor 4*e*, and the edge portion of the main body 4*f*1 of the pressing part 4*f* and the three-surface corner membrane panel M2 are welded to each other, and the three-surface corner membrane panel M2 and other membrane panels are welded to each other.

Moreover, the portions related to the two-surface corner membrane anchor mechanism 5 are assembled according to processes similar to those of three-surface corner membrane anchor mechanism 4 except that the filling portion for two-surface corner portion 2*d*5 having a triangular prism shape different from the filling portion for three-surface corner portion 2*d*4 is used, and the spacer 7 is disposed between the pressing part 5*f* and the two-surface corner membrane panel M3.

In the three-surface corner membrane anchor mechanism 4 of the present embodiment described above, the anchor 4*e* is attached to the rod-shaped leg portion 4*a* which is erected on the concrete wall 2*a*. In this way, the leg portion 4*a* and the anchor 4*e* are formed to be separated, and thus, it is possible to easily change the attachment posture of the anchor 4*e* with respect to the leg portion 4*a*. Accordingly, even when the through-hole 6 passing through the cold insulating material layer 2*d* and the membrane 2*b* is provided at any position, the attachment posture between the leg portion 4*a* and the anchor 4*e* is adopted according to a formation position of the through-hole 6, and thus, it is possible to easily dispose the anchor 4*e* at a position at which the anchor 4*e* can be inserted into the through-hole 6.

The pressing part 4*f* is fixed to the anchor 4*e* which is inserted into the through-hole 6 and the membrane 2*b* is pressed by the pressing part 4*f* Therefore, according to the three-surface corner membrane anchor mechanism 4 of the present embodiment, it is possible to press an arbitrary location of the membrane 2*b* by arbitrarily setting the position of the through-hole 6.

Moreover, the leg portion 4*a* can be erected at any location of the concrete wall 2*a*. Accordingly, it is possible to install the three-surface corner membrane anchor mechanism 4 regardless of whether or not a haunch structure is provided on the concrete wall 2*a*.

Moreover, according to the three-surface corner membrane anchor mechanism 4 of the present embodiment, the anchor 4*e* is supported by the rod-shaped leg portion 4*a*, and thus, a large space is formed between the anchor 4*e* and the concrete wall 2*a*. Accordingly, it is possible to easily dispose the cold insulating panel H1 in the space, and it is possible to easily dispose the cold insulating panel H1 around the three-surface corner membrane anchor mechanism 4 without a gap.

In addition, the three-surface corner membrane anchor mechanism 4 of the present embodiment presses the three-surface corner membrane panel M2 which is curved in a spherical surface shape. In this way, even when the membrane panel is curved, the three-surface corner membrane anchor mechanism 4 of the present embodiment can press an arbitrary location.

Moreover, the three-surface corner membrane anchor mechanism 4 of the present embodiment is disposed to press the center position in the thermal deformation part of the three-surface corner membrane panel M2. Accordingly, when the three-surface corner membrane panel M2 is thermally deformed, it is possible to suppress a large amount of stress from locally acting on the three-surface corner membrane panel M2 and the three-surface corner membrane anchor mechanism 4.

In addition, the three-surface corner membrane anchor mechanism 4 of the present embodiment includes the base portion 4*b* to which the leg portions 4*a* are connected, and the joint 4*d* which is provided on the base portion 4*b* and rotatably supports the anchor 4*e*. Accordingly, even when the position of the anchor 4*e* is deviated from the through-hole 6 during the assembly, it is possible to adjust the position of the anchor 4*e* at the assembly site.

Moreover, in the three-surface corner membrane anchor mechanism 4 of the present embodiment, the leg portion 4*a* includes the stud bolts (first stud bolt 4*a*1 and second stud bolt 4*a*2) provided on both ends, and the long nut 4*a*3 to which the stud bolts are screwed. Accordingly, the stud bolts and the long nut 4*a*3 can be easily attached to and detached from each other, and thus, it is possible to easily assemble the leg portion 4*a*.

In addition, also in the two-surface corner membrane anchor mechanism 5 of the present embodiment, operations and effects similar to those of the three-surface corner membrane anchor mechanism 4 of the present embodiment are exerted.

While preferred embodiments of the disclosure have been described and illustrated above, it should be understood that these are exemplary of the disclosure and are not to be considered as limiting. Additions, omissions, substitutions, and other modifications can be made without departing from the spirit or scope of the present disclosure. Accordingly, the disclosure is not to be considered as being limited by the foregoing description, and is only limited by the scope of the appended claims.

According to the present disclosure, it is possible to provide a membrane anchor mechanism which can support the corner membrane panel regardless of the presence or absence of the haunch structure, can press a location which is not limited to the edge portion of the corner membrane panel, and can easily dispose the heat insulating material in the periphery.

What is claimed is:

1. A membrane anchor mechanism which fixes a membrane provided on an inner wall surface side of a concrete wall via a heating insulating material to the concrete wall in a cryogenic tank, comprising:

a rod-shaped leg portion which is erected on the concrete wall;

an anchor which is supported by the leg portion, wherein the anchor is supported by the leg portion at a position such that the anchor is separated from the concrete wall, and wherein the anchor is inserted into a through-hole passing through the heat insulating material and the membrane, and wherein the anchor includes a tip which extends outside of the through-hole such that the tip is exposed to an inside of the cryogenic tank; and a pressing part which is fixed to the tip of the anchor at a position of the tip exposed to inside of the cryogenic tank, and wherein the pressing part presses the membrane.

2. The membrane anchor mechanism according to claim 1, wherein the membrane includes a corner membrane panel which is a curved membrane panel disposed at a corner portion of the cryogenic tank, and wherein a plurality of rod-shaped leg portions are provided, and the concrete wall includes a plurality of inner wall surfaces forming the corner portion, and wherein each rod-shaped leg portion is connected to an inner wall surface of the plurality of inner wall surfaces of the concrete wall forming the corner portion, and the pressing part presses the corner membrane panel.

3. The membrane anchor mechanism according to claim 1, wherein the pressing part is disposed to press a center position of a thermally deformable part of a membrane panel forming the membrane.

4. The membrane anchor mechanism according to claim 2, wherein the pressing part is disposed to press a center position of a thermally deformable part of a membrane panel forming the membrane.

5. The membrane anchor mechanism according to claim 1, further comprising:

a base portion to which the leg portion is connected; and a joint which is provided on the base portion and wherein the joint rotatably supports the anchor.

6. The membrane anchor mechanism according to claim 2, further comprising:

a base portion to which the leg portion is connected; and a joint which is provided on the base portion, and wherein the joint rotatably supports the anchor.

7. The membrane anchor mechanism according to claim 3, further comprising:

a base portion to which the leg portion is connected; and a joint which is provided on the base portion, and wherein the joint rotatably supports the anchor.

8. The membrane anchor mechanism according to claim 4, further comprising:

a base portion to which the leg portion is connected; and a joint which is provided on the base portion, and wherein the joint rotatably supports the anchor.

9. The membrane anchor mechanism according to claim 1, wherein the leg portion includes two ends, and stud bolts are provided on the two ends, and wherein nuts are screwed onto each of the stud bolts.

10. The membrane anchor according to claim 1, wherein the pressing part presses the membrane in a direction from the interior of the cryogenic tank toward the concrete wall.

11. The membrane anchor according to claim 1, further comprising a base portion, wherein the leg portion is connected to the base portion, and the anchor is connected to the base portion, such that the anchor is connected to the leg portion by way of the base portion.

12. The membrane according to claim 11, wherein a plurality of leg portions are provided, with the plurality of leg portions connected to the base portion, and wherein each leg portion is connected to a different inner wall surface of a plurality of inner wall surfaces of the concrete wall, such that said anchor is connected by way of the base portion to the plurality of leg portions connected to different inner wall surfaces of the concrete wall.

13. The membrane according to claim 12, further including a joint which rotatably couples the anchor to the base portion, wherein the joint is configured so that the anchor is rotatable about an axis, with said axis orthogonal to a direction in which the anchor extends.

14. The membrane according to claim 11, further including a joint which rotatably couples the anchor to the base portion, wherein the joint is configured so that the anchor is rotatable about an axis, with said axis orthogonal to a direction in which the anchor extends.

* * * * *